US009079740B2

(12) United States Patent
Haberstroh et al.

(10) Patent No.: US 9,079,740 B2
(45) Date of Patent: Jul. 14, 2015

(54) APPARATUS FOR STACKING SHEET MATERIAL

(75) Inventors: Markus Haberstroh, Landsberg am Lech (DE); Tobias Haberstroh, Munich (DE); Erwin Demmeler, Memmingen (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

(21) Appl. No.: 13/978,044

(22) PCT Filed: Feb. 10, 2012

(86) PCT No.: PCT/EP2012/000615

§ 371 (c)(1),
(2), (4) Date: Jul. 2, 2013

(87) PCT Pub. No.: WO2012/107239

PCT Pub. Date: Aug. 16, 2012

(65) Prior Publication Data

US 2013/0277910 A1 Oct. 24, 2013

(30) Foreign Application Priority Data

Feb. 10, 2011 (DE) ..... 10 2011 010 923

(51) Int. Cl.

| | |
|---|---|
| ***B65H 29/22*** | (2006.01) |
| ***B65H 29/40*** | (2006.01) |
| ***B65H 29/68*** | (2006.01) |

(52) U.S. Cl.

CPC ..... *B65H 29/22* (2013.01); *B65H 29/40* (2013.01); *B65H 29/68* (2013.01); *B65H 2301/4212* (2013.01); *B65H 2301/4473* (2013.01); *B65H 2301/4474* (2013.01); *B65H 2301/44765* (2013.01); *B65H 2301/51212* (2013.01); *B65H 2404/654* (2013.01); *B65H 2404/656* (2013.01); *B65H 2701/1912* (2013.01)

(58) Field of Classification Search

CPC ..... B65H 29/22; B65H 29/40; B65H 2301/44765

USPC ..... 271/314, 315, 307; 270/60

See application file for complete search history.

(56) References Cited

U.S. PATENT DOCUMENTS

| | | | | |
|---|---|---|---|---|
| 4,522,387 | A * | 6/1985 | Leuthold | 271/187 |
| 5,180,160 | A * | 1/1993 | Belanger et al. | 271/315 |

(Continued)

FOREIGN PATENT DOCUMENTS

| | | | |
|---|---|---|---|
| DE | 32 32 348 | A1 | 3/1984 |
| DE | 196 41 485 | A1 | 6/1997 |
| JP | 2010-155707 | A | 7/2010 |

OTHER PUBLICATIONS

International Search Report in PCT/EP2012/000615, May 11, 2012.

(Continued)

*Primary Examiner* — Patrick Cicchino
(74) *Attorney, Agent, or Firm* — Workman Nydegger

(57) ABSTRACT

The sheet compartments of a stacking wheel of a stacking device, as used in sheet goods processing devices, in particular in banknote processing machines and automated money deposit and/or withdrawal machines, have a wavy contour. The braking effect on the banknotes fed into the sheet compartments is thereby increased, so that the banknotes can be fed into the sheet compartments at increased speed without being damaged.

19 Claims, 2 Drawing Sheets

(56) References Cited

U.S. PATENT DOCUMENTS

| | | | | |
|---|---|---|---|---|
| 5,615,878 | A * | 4/1997 | Belanger et al. | 271/302 |
| 5,639,083 | A * | 6/1997 | Doucet | 271/315 |
| 5,647,586 | A * | 7/1997 | Novick et al. | 271/182 |
| 5,730,435 | A * | 3/1998 | Belanger et al. | 270/52.14 |
| 6,341,776 | B1 * | 1/2002 | Whitten | 271/187 |
| 2002/0060406 | A1 * | 5/2002 | Claudio | 271/187 |
| 2006/0012115 | A1 * | 1/2006 | Ko | 271/315 |

OTHER PUBLICATIONS

Search Report in German Patent Application DE 10 2011 010 923.4, Nov. 17, 2011.

* cited by examiner

APPARATUS FOR STACKING SHEET MATERIAL

BACKGROUND OF THE INVENTION

The invention relates to a stacker wheel as well as a stacking apparatus comprising one or several such stacker wheels for stacking sheet material. The invention furthermore relates to a sheet material processing apparatus comprising such a stacking apparatus, in particular for processing value documents such as for example bank notes. Such sheet material processing apparatuses can accordingly be money depositing and/or dispensing machines, value document processing machines in general and bank note processing machines for checking bank notes in particular.

Stacker wheels of the above-mentioned type possess sheet pockets distributed over the circumference for receiving one or several sheets of the sheet material to be stacked. The sheet material pockets extend in the stacker wheel from radially outside to radially inside along a substantially spiral-shaped course. Therefore, sheet material processing apparatuses that are equipped with such stacker wheels are normally referred to as "spiral pocket stackers".

Automatic sorting machines in which sheet-shaped objects, for example bank notes, are sorted must be able to process high numbers of items in as short a time as possible, which necessarily leads to high transport speeds. With conventional spiral pocket stackers, which have for example an outside diameter of 220 mm, an increase of the transport speed to more than 7.5 m/s is problematic, which corresponds to a processing of 30 bank notes per second. The problem consists substantially in the fact that upon their processing the bank notes, when running into the stacker wheel, are slowed down to a standstill within a short time on a short way. In particular with new and also with large-format bank notes this leads to the bank notes hitting against the end of the sheet pockets and consequently to damage at the leading bank note edges.

In DE-AS 12 48 561 there is described a spiral pocket stacker, wherein two disks rotating around a joint shaft and having slots extending in spiral-shaped fashion from the outside to the inside are arranged side by side. The slots of the discs that axially lie in congruence form one storage pocket each, in which a sheet is tangentially introduced. With the help of a stripper arranged between the discs, the sheets are discharged from the storage pockets. The circumferential speed of the discs is substantially lower than the transport speed of the sheets, so that the sheet running in frictionally slides with its surface along the outer boundary walls of the spiral-shaped slots. The frictional force arising from the relative motion slows down the sheet. Through the centrifugal force which becomes effective as a result of the diversion into a spiral path, the pressure of the documents against the corresponding boundary walls is further increased, which is why the friction, however dependent on the speed, is intensified. However, the slowing down may be insufficient, even when the stacking apparatus is provided with several spiral disks for increasing the effective friction surface. Primarily more rigid sheets, such as for example new bank notes before they are brought into circulation, bounce with too high speeds against the sheet pocket ends or against the stripper and are reflected therefrom. In so doing, the sheet may prematurely exit from the sheet pocket, which necessarily leads to a failure of the stacking process. If sheets with rather soft, limp quality impinge with too high speeds on the sheet pocket ends or on the stripper, an accordion-like deformation, primarily in the front region of the sheet, is possible. Damage or at least an inaccurate alignment in the subsequent stacking is often the result.

There have been made all sorts of proposals as to how the friction for slowing down the sheets upon their running into the stacker wheel can be increased. In DE 32 32 348 A1 it is proposed to mutually "stagger" the spiral-shaped sheet pockets of stacker wheels arranged side by side on a joint drive shaft. Staggering is understood to mean that the sheet pockets extending in spiral-shaped fashion, upon viewing along the drive shaft, are not congruent to each other but extend differently. The sheets running into the sheet pockets thus go wavy in a direction transverse to the run-in direction. This can be achieved in that individual sheet pockets have a different spiral curvature than other sheet pockets, on the one hand. The same effect can also be achieved, on the other hand, with identical stacker wheels, whose sheet pockets all have the same spiral curvature, when at least one of the stacker wheels is mounted on the drive shaft rotated by a small angular amount relative to the other stacker wheels. On account of the wavy curvature imposed upon the running into the stacker wheels, the pressure of the sheets against the boundary walls of the spiral slots is intensified and, consequently, frictional forces and thus the braking effect increase accordingly.

DE 101 10 103 A1 complains about this, that the imposed waving may lead to slight deformations of the bank notes in the sheet pockets and thus to an inaccurate stacking. In DE 101 10 103 A1 it is instead proposed to adjust the width of the sheet pockets to the type of the sheets to be respectively stacked. For this purpose, the stacker fingers, respectively two neighboring stacker fingers thereof forming a storage pocket, are rotatably mounted at the stacker wheel shaft. By swiveling the stacker fingers in the one direction or the other the distance of the outer tips of the neighboring stacker fingers and consequently the width of the associated sheet pocket is enlarged or diminished. This ultimately again influences the braking force that acts on the sheets running in. Such mechanisms are elaborate in the manufacturing and prone to maintenance.

Instead of this, also separate braking bodies can be used, which are arranged in meshing fashion with the stacker wheels, in order to form an additional braking surface for the sheets running in. In DE 10 2008 000 026 B3 it is for example proposed to configure such a braking body as a rotating braking roller. This type of slowing down requires additional components, which increases the manufacturing effort and maintenance effort.

For a stronger slowing down of the sheets, also stacker wheels having a larger diameter and thus a longer braking distances can be employed. This, however, is disadvantageous due to the increased space requirement.

It is therefore the object of the present invention to create a stacking apparatus for processing sheet material, such as bank notes, wherein, even at high transport speeds, damage to the sheet material to be stacked is avoided.

SUMMARY OF THE INVENTION

The sheet pockets of the stacker wheel possess a special course along the stacker wheel from radially outside, where the sheets run into the stacker wheel, to radially inside, where the sheets come to a standstill relative to the stacker wheel. This course has—viewed along the respective sheet pocket from radially outside to radially inside—a first curvature, in particular a positive curvature, in a first section and directly adjacent thereto—in relation to the curvature of the sheet pocket curve—an inflection point. The inflection point effects an in comparison to the prior art increased braking effect. For the purposes of this application, a curvature in the direction of the stacker wheel shaft is referred to as a positive curvature of the sheet pocket course, viewed along the sheet pocket from radially outside to radially inside, and a curvature of the sheet pocket course which faces away from the stacker wheel shaft is accordingly referred to as a negative curvature. The inflection point forms the transition between the first section in which the sheet pocket has a positive curvature and a second section adjacent thereto. In the second section, the sheet pocket preferably has a curvature inverse to the first curvature, in particular a negative curvature. The second section can also be configured partly straight. The sheet pockets of the stacker wheel in particular extend in wavy fashion, viewed from radially outside to radially inside along the respective sheet pocket.

The inflection point can also be a discontinuous transition between the first and the second section, such as a sharp bend. For example, the first section can be positively curved and the second section be configured substantially straight. In the curved first section a sheet running into the stacker wheel already undergoes a braking effect. The bank notes in the curved first section of the stacker wheel take on the usual bent form here.

But by the fact that now the curved first section has adjacent thereto an inflection point, the sheet running into the stacker wheel is forced in the further course of the sheet pocket to change from the first, positive curvature into the second, negative curvature. Through the inflection point there is achieved a wavy deformation of the sheet material along the moving direction of the sheet material, i.e. on the respective sheet one or several waves are imposed, whose wave troughs and wave crests alternate along the moving direction of the sheet. In this way two advantages are achieved. On the one hand, the friction on the sheet running into the stacker wheel is increased stronger along the course of the sheet pocket than with a stacker wheel whose sheet pockets are throughout positively curved. Furthermore, at the same time the length of the sheet material pockets in the stacker wheel is increased while the stacker wheel diameter remains the same. Further additional braking devices are not absolutely necessary. Altogether, a stacking apparatus equipped with such stacker wheels can be operated with significantly higher processing speeds. The processing of bank notes with a transport speed of 10 m/s, corresponding to about 40 bank notes per second, can be achieved in this way with stacker wheels that e.g. possess an outside diameter of 220 mm. Due to the improved slowing down, also the noise emission is declined, because less bank notes hit against the end of the sheet pocket, and altogether also the risk of the sheets being damaged on their leading edge upon stacking is lowered. Finally, as an advantage there is to be mentioned that due to the special sheet pocket geometry sheet material, in particular bank notes, of the most different mechanical properties can be stacked well, regardless of whether used sheet material, freshly printed sheet material or polymer banknotes are stacked.

Preferably, the course of the sheet pockets in the individual sections is curved. At the radially interior end of the sheet pocket and/or in particular on the radially exterior, open end of the sheet pocket the course can be linear, as this is proposed for example in WO 2007/068887 A1.

Preferably, the course of the sheet pocket has at least one further inflection point, which lies radially interior relative to the first inflection point. When the sheet pocket in its course from radially outside to radially inside is first curved inwardly in the direction towards the stacker wheel shaft, as this is the case with the known stacker wheels, then the course of the sheet pocket tends to distance itself from the stacker wheel shaft after the first inflection point and again tends to approach the stacker wheel shaft behind the next following inflection point. Between the two inflection points there is thus a wave trough.

The sheet pockets are formed such that the two sheet pocket surfaces, which form the boundary of the respective sheet pocket, extend substantially parallel to each other. Each of the two surfaces of the respective sheet pocket has—viewed along the respective sheet pocket from radially outside to radially inside—in a first section a positive curvature and directly adjacent thereto an inflection point. In particular, both surfaces of the respective sheet pocket have a wavy course, the inflection points of the two sheet pocket surfaces—viewed along the sheet pocket—respectively lying at the same position. This imposes a uniform curvature on the sheet material from both sides at each position along the sheet pocket, which curvature makes possible a defined slowing down of the sheet material without the risk of damage.

Preferably, the sheet pockets are respectively so constituted that the sheet pocket width—viewed from radially outside to radially inside—consistently decreases or at least remains the same, but—viewed from radially outside to radially inside—at no point of the sheet pocket increases. In particular, along the sheet pockets there is not present any constriction, at which the two surfaces of the respective sheet pocket come closer to each other than—viewed along the sheet pocket from radially outside to radially inside—at a position after this constriction. This avoids damage to the sheet material, which especially in the case of sheet material of a poor state may be caused by any constrictions of a sheet pocket.

Preferably, the course of the sheet pocket is continuously curved in all sections bordering the inflection points. This applies in particular to the section behind the last inflection point, whose radius of curvature preferably increases radially inwardly. Deviating from the hitherto usual sheet pocket courses, the sheet pocket thus extends preferably weakly wavy with slight change of direction, which first is gently initiated and intensifies a little towards the end of the sheet pocket.

The amplitude of such a wave of the wavy sheet pocket course preferably lies in the region of 1 mm to 4 mm, particularly preferably between 2 mm and 4 mm. The amplitude is defined as the maximum distance that one of the two surfaces of the sheet pocket concerned has at a point between the two inflection points relative to a tangent at this surface, the tangent touching this surface, viewed along the sheet pocket, before and after the point concerned. A larger wave amplitude lengthens the available braking distance for the sheet material along the sheet material pocket.

Preferably, two inflection points are provided along the sheet pocket. Optionally, however, there can also be provided more than two inflection points, e.g. a multiple of two inflection points, thus for example four, six, or, where applicable, eight inflection points. An integral number of inflection points has the advantage, that the generally spiral-shaped course of the sheet pocket with a curvature increasing at the end of the sheet pocket toward the stacker wheel shaft can be maintained.

Preferably, the one or more inflection points lie in certain regions along the sheet pocket. When the length of a sheet pocket is understood to be the course of the sheet pocket from its radially outer, open end up to its radially inner end, the first inflection point lies—viewed along the sheet pocket from radially outside to radially inside—, in at least one of the sheet pockets, preferably in all sheet pockets, in a region of 40% to 70% of the sheet pocket length, preferably in a region of 40% to 60% of the sheet pocket length. Since the sheet material, upon its motion from the outside to the inside along the sheet pocket, reaches the first inflection point already at an early stage, a particularly effective slowing down of the sheet material is achieved. A particularly preferred location of the first inflection point amounts to about 50% of the sheet pocket length. This makes it possible that also sheet material of various mechanical properties are stacked reliably and without damage. The beginning of the respective sheet pocket, from which the length of the sheet pocket is determined, is here—viewed from radially outside to radially inside—the first position of the sheet pocket at which the respective sheet pocket is limited on both sides by stacker wheel fingers of the stacker wheel, which stacker wheel fingers form the two surfaces of the respective sheet pocket.

The next inflection point—viewed from radially outside to radially inside—then lies preferably in a region of 50% to 80%, in particular 60%-70%, of the length of the sheet pocket. Preferably, the first inflection point is spaced apart from the next inflection point by 5% to 30%, particularly preferably by 5% to 20%, in particular by 10% to 20%, of the length of the sheet pocket. With each further inflection point the braking effect acting on the sheet running in increases.

The width of the sheet pockets tapers preferably from radially outside to radially inside. On the radially exterior, open end the sheet pockets possess preferably a width in the region of 5 mm to 15 mm. After the taper, the sheet pockets have only a width of 0.2 mm to 1.5 mm, preferably a width of 0.2 mm to 1.0 mm. At the position of the first inflection point the sheet pocket width lies preferably between 0.5 mm and 1 mm. This small sheet pocket width can achieve that the sheets are already very strongly slowed down before these reach the sheet pocket end. The sheet strongly hitting against the sheet pocket end is thus avoided and the noise emission of the stacking reduced. Even at high transport speeds, damage to the sheet material to be stacked can thus be avoided.

In particular, the sheet pocket width adjacent to the taper can remain substantially constant. In the prior art, the sheet pocket width, in contrast, usually is at least 1.7 mm along the sheet pocket. By the pocket width reduced compared to the prior art the frictional force acting on the sheet material running in is further increased, so that the braking effect in the wavy region of the pocket is even additionally intensified thereby. The taper—viewed along the sheet pocked from radially outside to radially inside—preferably lies substantially in a region of 20% to 40% of the sheet pocket length. Viewed along the respective sheet pocket from radially outside to radially inside, the sheet pockets taper preferably in a region of 20% to 40% of the length of the respective sheet pocket stronger than in the remaining regions of the respective sheet pocket. This, too, achieves a particularly effective slowing down of the sheet material upon its motion from the outside to the inside along the sheet pocket.

In order to further optimize the stacking, the sheet pockets of the stacker wheel, in particular the sheet pocket course, the sheet pocket width and the wave amplitude can be chosen differently in dependence on the sheet material quality. For example, for new bank notes or bank notes in a good state of use it may be advantageous to employ a stacker wheel with a smaller sheet pocket width than for used, limp bank notes.

The braking effect can be additionally increased, when in a stacking apparatus two or several stacker wheels are used that are mounted on the same stacker wheel shaft, for example four, five, or six stacker wheels. The number of the stacker wheels mounted on a shaft can be chosen in dependence on the desired braking effect, on the one hand, and in dependence on the breadth of the sheet material to be stacked, on the other hand, in the case of broader sheet material more and in the case of narrower sheet material less stacker wheels. Thus, for example, the stacking can be optimized in targeted fashion for individual kinds of bank notes.

A still further increase of the braking effect on the sheet material to be stacked can be achieved, when at least one sheet pocket, preferably all sheet pockets, of one or several stacker wheels is arranged in staggered fashion relative to at least one or all sheet pockets of one or several other stacker wheels, as this was explained hereinbefore with respect to DE 32 32 348 A1. In particular, two or more identical stacker wheels can be arranged on a joint rotational shaft with different orientation of their respective sheet pockets. On the sheets running into the sheet pockets, there is then imposed a wavy deformation not only along their moving direction, but also in a direction transverse thereto. The wave troughs and wave crests thereof are arranged alternately along a direction transverse to the moving direction of the sheet.

Through the first and, where applicable, the one or the further inflection points of the sheet pocket there is achieved a wavy deformation of the sheets along their moving direction. Through the mentioned staggering of two or more stacker wheels there is additionally achieved a wavy deformation of the sheets transversely to the moving direction of the sheet material. Through wavy deformations both in the moving direction (also referred to as "longitudinal direction") and also transversely to the moving direction of the sheet material (also referred to as "transverse direction") there is achieved a particularly effective three-dimensional deformation of the sheet material. This achieves in particular a wavy deformation of the respective sheet along its moving direction, which is different in dependence on the position transverse to the moving direction of the sheet. If e.g. two parallel directions along the moving direction of the sheet material are viewed, the wave crests and wave troughs of this deformation lie at different positions along these two parallel directions. Since through this three-dimensional deformation of the sheets the friction at the sheet pocket surfaces is very strongly increased, there is thus achieved a very effective and damage-free slowing down of the sheets. This three-dimensional deformation furthermore allows the extent of the deformation of the sheet material in the longitudinal direction and the extent of the deformation of the sheet material in the transverse direction, respectively considered by itself, to be kept so low that in each of the two directions an excessively strong deformation of the sheet material is not effected. Because by an excessively strong wavy deformation the sheet material can become jammed in one of the two directions in the sheet pocket such that this may lead to problems upon stripping the sheet material. Through the three-dimensional deformation a lower amplitude of the wavy deformation in the longitudinal direction as well as a lower staggering of the stacker wheels are sufficient for the sheet material to be effectively and damage-free slowed down and safely stripped from the stacker wheel.

As already mentioned, such a stacking apparatus usually has a stripper, which strips the bank notes from the pockets of the stacker wheels upon the rotation of the stacker wheels. Preferably, the form of the stripper is adjusted to the course of the pockets of the invention. Because it is considered to be advantageous, when, upon stripping, the sheets with their edges rest against the stripper in a right angle or in a slightly obtuse angle, if possible, and this during the entire stripping process, if possible, that is, at each angular position of the stacker wheel, in which the stripper meshes with the sheet pockets. Upon the operation of the stacker wheel, the sheets to be stripped from the sheet pockets of the stacker wheel impinge on the stripper in a contact zone of the stripper. The course of the contact zone of the stripper is adjusted to the course of the sheet pockets. The contact zone of the stripper has for example a wavy course matching the course of the sheet pocket. However, the contact zone can also consistently have a course with uniform curvature (i.e. with which no sign change of the curvature is present), in particular a course without inflection point.

Preferably, the stripper and the sheet pockets are adjusted to each other such that at least 60% of the contact zone of the stripper, preferably at least 90%, forms with the respective sheet pockets an angle of 70° to 110° during the stripping process. In particular, at least 60% of the contact zone of the stripper form with the respective sheet pockets an angle between 90° and 110°, preferably at least 90%, during the stripping process. The stated angle is—related to the respective sheet pocket—the angle facing the stacker wheel shaft, which the sheet pocket encloses with the contact zone of the stripper during the stripping process.

The stripper and the sheet pockets are preferably adjusted to each other such that the (above-mentioned) angle facing the stacker wheel shaft between the stripper and the sheet pocket, at the point of impingement of the sheet material on the stripper, amounts to at least 70°, preferably at least 80°, particularly preferably at least 90°. The point of impingement is here the first point of intersection between the sheet pocket and the surface of the stripper, which the sheet pocket forms with the stripper upon the rotation of the stacker wheel, or that point of the contact zone of the stripper at which the stripping of the sheet material begins. This minimum angle achieves that the sheet material is quickly stripped from the stacker wheel, i.e. that the stripping is effected over a small angular range of the stacker wheel rotation if possible. The angle, which faces the stacker wheel shaft, between the stripper and the sheet pocket at the point of impingement of the sheet material preferably amounts to no more than 110°. This ensures a trouble-free stripping of the sheet material. An angle of more than 110° may lead to the fact that the sheet material is not properly stripped, but that it becomes jammed between stacker wheel and stripper and is damaged thereby.

The stripper is arranged at the stacker wheel such and configured such that it is not employed for slowing down the sheet material, but only for stripping the sheet material from the stacker wheel. The stripper thus only contacts the sheet material after the sheet material has come to a standstill relative to the stacker wheel. This avoids an acceleration of the sheet material through the stripper, which acceleration would act opposite to the moving direction of the sheet material.

BRIEF DESCRIPTION OF THE DRAWINGS

Hereinafter the invention will be explained by way of example with reference to the following Figures. There are shown.

DETAILED DESCRIPTION OF PREFERRED EMBODIMENTS

Figure 1:
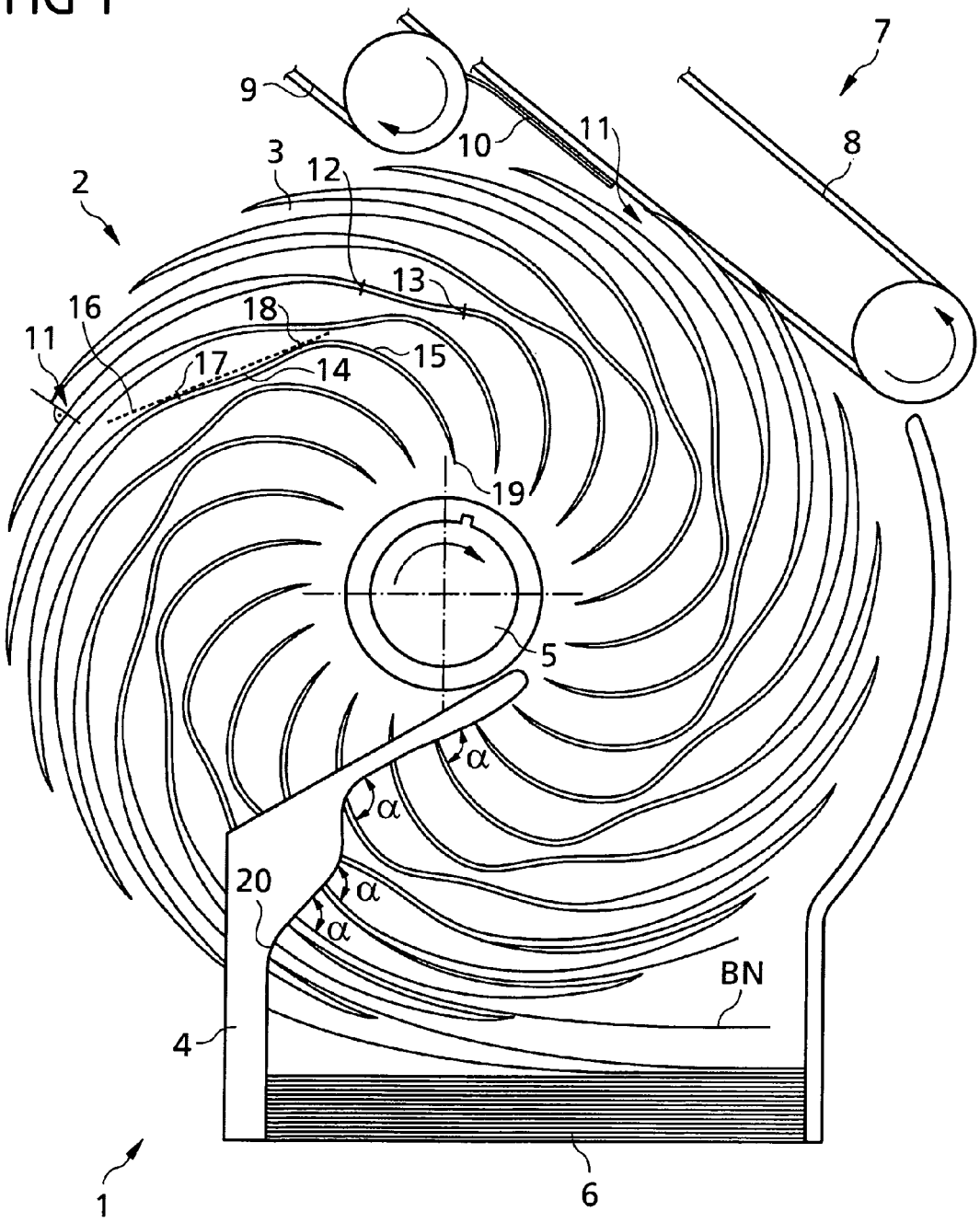
FIG. 1 stacking apparatus according to a first embodiment.
Figure 2:
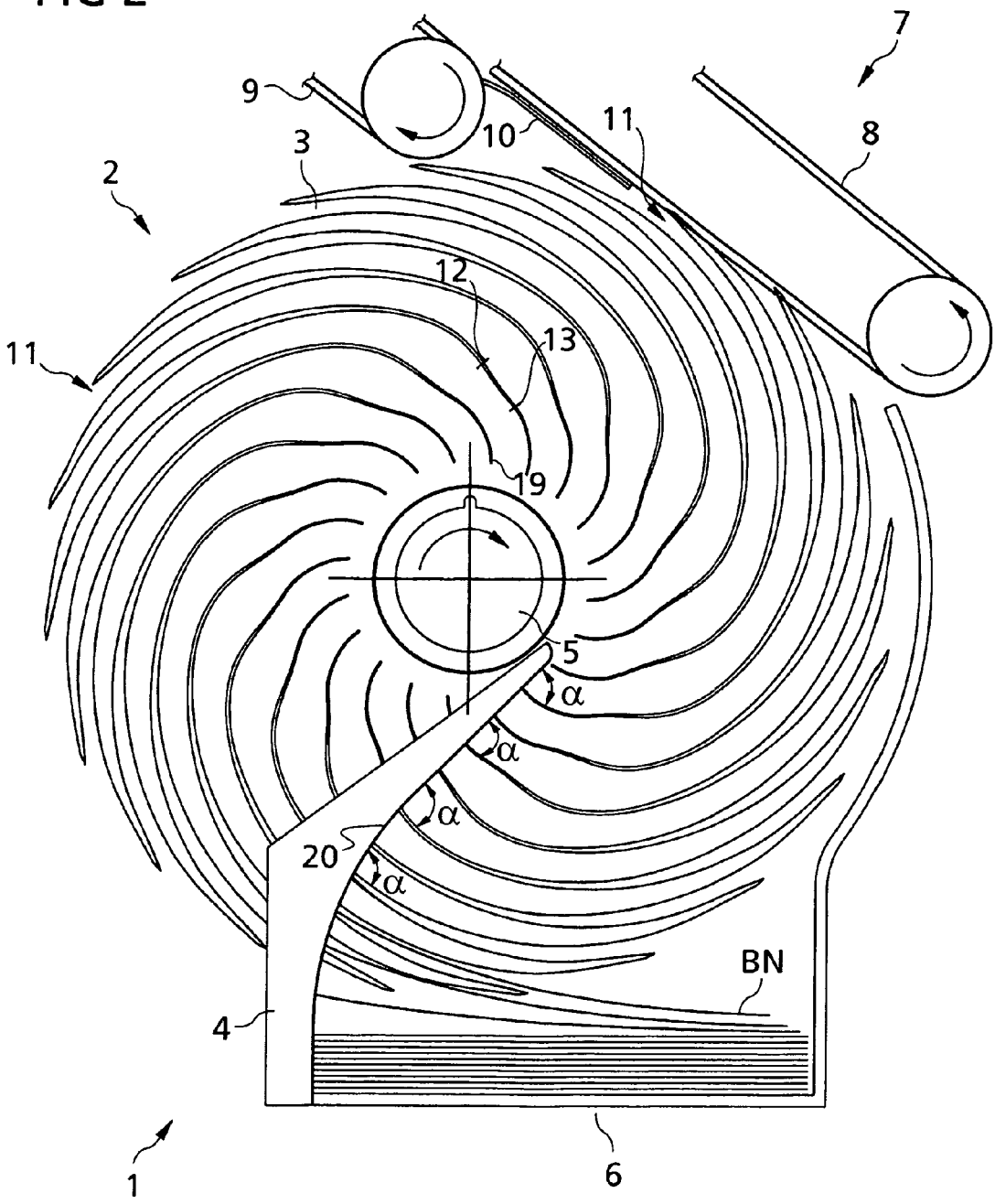
FIG. 2 stacking apparatus according to a second embodiment.

The FIGS. 1 and 2 respectively show a stacking apparatus 1 that is suitable for the use in money depositing and/or dispensing machines or other value document processing machines, in particular bank note processing machines for checking and/or sorting bank notes, because both limp and freshly printed bank notes can be safely stacked therewith. With stacker wheels 2 of the represented type bank notes of a great variety of qualities can be stored into a uniform stack without damage. Stacker wheels 2 of this type are suitable in particular also for bank note processing machines with which bank notes are checked before these come into circulation. Such bank notes possess a comparatively low coefficient of friction, so that they must be slowed down very effectively, in order for they not to strike with force against the end of the sheet pockets 3 of the stacker wheel 2 upon running into the stacker wheel 2.

The stacking apparatus 1 accordingly comprises a stacker wheel 2 with sheet pockets 3 arranged distributed over the circumference for receiving individual sheets, in particular bank notes BN. Hereinafter, on account of the preferred application purpose, for simplicity's sake, bank notes are referred to as sheet material to be stacked. The stacking apparatus 1 furthermore possesses a stripper 4, with which the bank notes BN are stripped from the sheet pockets 3, when the stacker wheel 2 rotates clockwise around the rotational shaft of the stacker wheel hub 5. For illustrating this process, in the lower sheet pockets of the stacker wheel 2 there are represented bank notes BN, how they are stripped and stacked on a storage area 6. Above the stacker wheel 2 there is provided a transport apparatus 7, which can be part of the stacking apparatus or part of a larger sheet material processing apparatus. The transport apparatus 7 in the represented embodiment is formed by two transport bands 8, 9, between which the bank notes to be stacked are successively fed at a small distance and with high speed to the rotating stacker wheel 2. A guiding plate 10 directs the delivered bank notes up to the entrance opening 11 of a sheet pocket 3 being in receiving position. The transport speed of the transport bands 8, 9 is substantially higher than the circumferential speed of the stacker wheel 2. The transport of the transport bands and the rotation of the stacker wheel are mutually coordinated in such a way that always only exactly one bank note dives into a sheet pocket 3 and the next following bank note into the respective next sheet pocket 3.

Several stacker wheels 2 are mounted respectively in a specified distance from each other side by side on the stacker wheel hub 5 in the stacking apparatus 1. In the two embodiments, the sheet pockets 3 are identical for all stacker wheels and are arranged in such a way that in the represented view according to FIGS. 1 and 2 only the foremost stacker wheel 2 can be seen. Alternatively, however, a staggered arrangement of the stacker wheels on the hub 5 is also possible, as described hereinabove. Into the spacings between the stacker wheels 2 there engage belts of the upper transport band 8, on the one hand, and the stripper 4, on the other hand, which consists of several elements arranged side by side, which respectively engage in meshing fashion between two stacker wheels 2.

The stacking apparatus 1 has a special course of the sheet pockets 3 in the stacker wheel 2. In contrast to conventional stacker wheels, the sheet pocket course does not consistently follow a positive curvature intensifying towards the stacker wheel hub 5. Rather, the direction of the curvature changes according to the invention at least at one point. In the represented embodiment, the direction of the curvature changes even twice, namely at the two inflection points 12 and 13. At the inflection point 12 the curvature of the sheet pocket changes from positive to negative and at the inflection point 13 from negative to positive. In the stacker wheel represented here, the course of the sheet pockets 3 is identical for all sheet pockets 3, so that the inflection points 12 and 13 respectively lie at the same point. However, there can also be provided deviations of the sheet pocket course for the pockets of the stacker wheel 2, in order to enlarge the material breadth of the stacker wheel 2 between two neighboring sheet pockets. On account of the inflection points 12, 13 there arises in particular a weakly wavy course with two slight changes of the direction of the curvature, which changes are respectively gently initiated. Towards the stacker wheel hub 5 the curvature intensifies.

Between the two inflection points 12, 13 there lies a wave trough. The amplitude of the wave trough determines the intensity with which a bank note running into the sheet pocket 3 is slowed down. This amplitude lies preferably between 1 mm and 4 mm. The amplitude is measured as a maximum distance between the surface 15 of a sheet pocket 3 forming the wave ground 14 and a tangent that is denoted with 16 in FIG. 1 and which is tangent to the same surface 15 on the right and left side of the point 14 concerned.

The tangent points are denoted with 17 and 18 in FIG. 1. They lie slightly outside the two inflection points 12 and 13.

The width of each sheet pocket 3 tapers in the direction towards stacker wheel hub 5. In so doing, the width first remains relatively broad over a longer section, e.g. with 5 to 15 mm at the entrance opening 11 of the sheet pocket 3. The length of each sheet pocket 3 begins with the entrance opening 11 and ends at the end of the sheet pocket 3 near the stacker wheel hub 5. The taper of the width of the sheet pockets 3 from the width at the entrance opening 11 to a width of e.g. only 1.5 mm or 1 mm is not effected uniformly over the entire length, but over a relatively short section, which lies—viewed from radially outside to radially inside—in the region of 20%-40% of the sheet pocket length. Adjacent thereto, the sheet pocket width further tapers, where applicable, but this further taper is significantly less intense. The sheet pocket width should not be less than 0.2 mm, when the stacking apparatus serves for stacking bank notes, in order to obtain a good stacking quality of the bank notes.

The inflection points 12 and 13 in the course of the sheet pockets 3, however, lie at about 40% to 60% of the sheet pocket length for the first inflection point 12, in the shown example of FIG. 1 at about 50%, and at about 50% to 80% of the sheet pocket length for the second inflection point 13, in the shown example of FIG. 1 at about 70%, respectively viewed along the sheet pocket 3 from radially outside to radially inside.

Through a suitable choice of the material for the stacker wheel the braking effect can be further optimized. A metallic material, e.g. aluminum, is preferred due to the high braking effect and the wear-resistant surface. Plexiglass (PMMA) or polycarbonate (PC; e.g. Makralon®), are to be preferred, however, when transparent material is desired. The material thickness of the stacker wheel amounts to e.g. 3 to 5 mm.

The stripper 4 is adjusted to the wavy course of the sheet pockets 3 both in FIG. 1 and in FIG. 2, in order to achieve that the bank notes received in the sheet pockets 3 impinge with their leading edges on a contact zone 20 of the stripper 4 at a right angle or an obtuse angle between 90° and 110°, if possible. In the case of the stripper of FIG. 1, the contact zone 20 has an accordingly curved or wavy course. The angle $\alpha$, facing the stacker wheel shaft, that the sheet pocket 3 encloses with the stripper 4 during the stripping process, should lie between 90° and 110° over a large part of the contact zone 20. The angle $\alpha$ in FIG. 1 is drawn in as an example for different sheet pockets 3. In the represented embodiment, in the top section of the stripper the angle $\alpha$ amounts to between 85° and 110°. It has to be mentioned, however, that the represented contour of the contact region 20 only serves for illustrative purposes and is not true to scale.

The stripper 4 of FIG. 2 is, in contrast to that of FIG. 1, uniformly curved, i.e. without wave form. As the wave form is less pronounced in the sheet pockets 3 of the stacker wheel of FIG. 2, it is not necessary for the stripper of FIG. 2 to have a wavy course of the contact zone. The adjustment to the sheet pockets aiming at a right angle $\alpha$ if possible is achieved with the form of the stripper 4 shown in FIG. 2.

The invention claimed is:

1. A stacker wheel comprising sheet pockets distributed over the circumference for receiving one or several sheets of sheet material, which extend in the stacker wheel from radially outside to radially inside, wherein each of the sheet pockets is formed by a first surface facing a second surface, and both the first surface and the second surface of each of the sheet pockets have a wavy course of the sheet pockets, viewed along the respective sheet pocket from radially outside to radially inside, both the first surface and the second surface each having a first curvature, in particular a positive curvature, in a first section and a first inflection point between the first section and a second section adjacent thereto, and wherein the first inflection point of both the first surface and the second surface, viewed along the respective sheet pocket from radially outside to radially inside, lies in a region of 40% to 70% of the length of the respective sheet pocket, and wherein the sheet pockets are so constituted that the width of the respective sheet pocket, viewed from radially outside to radially inside, consistently decreases or remains the same, but, viewed from radially outside to radially inside, at no point of the sheet pocket increases.

2. The stacker wheel according to claim 1, wherein the sheet pockets respectively have at least one further inflection point, which compared to the first inflection point of the respective sheet pocket lies closer to the stacker wheel shaft.

3. The stacker wheel according to claim 2, wherein the further inflection point of the respective sheet pocket, which lies closest to the first inflection point of the respective sheet pocket, lies, viewed along the sheet pocket from radially outside to radially inside, in a region of 50% to 80% of the length of the sheet pocket, and wherein the further inflection point is spaced apart from the first inflection point by 5% to 20% of the length of the respective sheet pocket.

4. The stacker wheel according to claim 1, wherein the course of the sheet pockets is wavy.

5. The stacker wheel according to claim 4, wherein the amplitude of at least one wave of the wavy course amounts to between 1 mm and 4 mm, wherein the amplitude is defined as the maximum distance that one of the two surfaces of the respective sheet pocket has at a point between the two inflection points relative to a tangent at this surface, which tangent touches this surface, viewed along the sheet pocket, both before and after the point concerned.

6. The stacker wheel according to claim 1, wherein the sheet pockets taper from radially outside to radially inside, wherein the width of the respective sheet pocket, viewed along the sheet pocket from radially outside to radially inside, behind the taper amounts to at least 0.2 mm and at most 1.5 mm.

7. A stacking apparatus for stacking sheet material, comprising at least one stacker wheel according to claim 1, wherein the stacking apparatus includes at least one stripper or stripping sheets from the sheet pockets of the stacker wheel or the stacker wheels.

8. The stacking apparatus according to claim 7, comprising a first stacker wheel and a second stacker wheel, wherein the sheet pockets of the first stacker wheel o are arranged in staggered fashion relative to the sheet pockets of the second stacker wheel in such a way that there is imposed on the sheets running into the sheet pocket a wavy deformation in a direction transverse to the moving direction of the sheets.

9. The stacking apparatus according to claim 7, wherein the stacking apparatus for stacking sheet material comprises at least two stacker wheels according to claim 16, and wherein the respective sheet obtains through the first inflection point a wavy deformation along its moving direction and, through the staggering of the at least two or more stacker wheels, additionally a wavy deformation transverse to its moving direction, so that a wavy deformation of the respective sheet along its moving direction is achieved, which is different in dependence on the position transverse to the moving direction of the sheet.

10. An apparatus for processing sheet material, comprising at least one stacking apparatus according to claim 7, wherein the apparatus is in particular a processing machine for checking value documents, in particular a bank note processing machine.

11. The stacking apparatus according to claim 7, wherein the stripper has a contact zone for contacting sheets to be stripped from the sheet pockets of the at least one stacker wheel, whose course is adjusted to the course of the sheet pockets.

12. The stacking apparatus according to claim 11, wherein the contact zone of the stripper is adjusted to the course of the sheet pockets in such a way that, in the stripping process of the sheets, at least a portion of 60% of the contact zone, in particular 90% of the contact zone, respectively forms with the sheet pockets an angle facing the stacker wheel shaft of between 70° and 110°.

13. The stacking apparatus according to claim 11, wherein the contact zone of the stripper is adjusted to the course of the sheet pockets in such a way that the angle, which faces the at least one stacker wheel shaft, between the stripper and the sheet pocket at the point of impingement of the sheet material on the stripper amounts to at least 90° and at most 110°.

14. The stacking apparatus according to claim 11, wherein the contact zone of the stripper is adjusted to the course of the sheet pockets in such a way that, in the stripping process of the sheets, at least a portion of 60% of the contact zone, in particular 90% of the contact zone, respectively forms with the sheet pockets an angle facing the stacker wheel shaft of between 90° and 110°.

15. The stacker wheel according to claim 1, wherein the first inflection point, viewed along the respective sheet pocket from radially outside to radially inside, lies in a region of 40% to 60% of the length of the respective sheet pocket.

16. The stacker wheel according to claim 1, wherein the sheet pockets taper from radially outside to radially inside, wherein the width of the respective sheet pocket, viewed along the sheet pocket from radially outside to radially inside, behind the taper amounts to at least 0.2 mm and at most 1.0 mm.

17. The stacker wheel according to claim 1, wherein the inflection points of the first surface and the inflection point of the second surface, viewed along the sheet pocket from radially outside to radially inside, lie at the same position.

18. The stacker wheel according to claim 1, wherein the outside diameter of the stacker wheel is about 220 mm and the stacker wheel is configured to achieve a processing speed of 10 m/s or about 40 bank notes per second.

19. A stacking apparatus for stacking sheet material, the stacking apparatus comprising at least one stacker wheel, the at least one stacker wheel including sheet pockets distributed over the circumference for receiving one or several sheets of sheet material, the sheet pockets extending in the stacker wheel from radially outside to radially inside, wherein each of the sheet pockets is formed by a first surface facing a second surface, and both the first surface and the second surface of each of the sheet pockets have a wavy course of the sheet pockets, viewed along the respective sheet pocket from radially outside to radially inside, both the first surface and the second surface each having a first curvature, in particular a positive curvature, in a first section and a first inflection point between the first section and a second section having a second curvature, wherein the first inflection point of both the first surface and the second surface, viewed along the respective sheet pocket from radially outside to radially inside, lies in a region of 40% to 70% of the length of the respective sheet pocket, wherein the sheet pockets are so constituted that the width of the respective sheet pocket, viewed from radially outside to radially inside, consistently decreases or remains the same, but, viewed from radially outside to radially inside, at no point of the sheet pocket increases, wherein the stacking apparatus further comprises at least one stripper configured to strip sheets from the sheet pockets of the stacker wheel, and wherein the contact zone of the stripper is adjusted to the course of the sheet pockets in such a way that the angle, which faces the at least one stacker wheel shaft, between the stripper and the sheet pocket at the point of first impingement of the sheet material on the stripper amounts to at least 70° and at most 110°.

* * * * *